US005368765A

United States Patent [19]

Kaneko

[11] Patent Number: 5,368,765

[45] Date of Patent: Nov. 29, 1994

[54] LUBRICATING OIL AND COMPOSITIONS FOR THE HYDROGEN-CONTAINING FLON REFRIGERANTS

[75] Inventor: Masato Kaneko, Ichihara, Japan

[73] Assignee: Idemitsu Kosan Co., Ltd., Tokyo, Japan

[21] Appl. No.: 455,847

[22] Filed: Dec. 21, 1989

Related U.S. Application Data

[63] Continuation of Ser. No. 259,590, Oct. 19, 1988, abandoned.

[30] Foreign Application Priority Data

Oct. 28, 1987 [JP] Japan ..... 62-270389
Oct. 28, 1987 [JP] Japan ..... 62-270390

[51] Int. Cl.[5] ..... C09K 5/00
[52] U.S. Cl. ..... 252/68; 252/52 R
[58] Field of Search ..... 252/68, 69, 52 R, 45

[56] References Cited

U.S. PATENT DOCUMENTS

| | | | |
|---|---|---|---|
| 3,092,981 | 6/1963 | Begeman et al. | 252/68 |
| 3,609,085 | 9/1971 | Langenfeld | 252/56 |
| 3,642,634 | 2/1972 | Olund | 252/68 |
| 4,427,561 | 1/1984 | Kusayanagi et al. | 252/45 |
| 4,983,313 | 1/1991 | Kaneko et al. | 252/68 |
| 5,049,292 | 9/1991 | Grasshoff et al. | 252/49.6 |

FOREIGN PATENT DOCUMENTS

| | | | |
|---|---|---|---|
| 2362857 | 12/1973 | Germany | 252/68 |
| 58-103594 | 6/1983 | Japan . | |
| 123577 | 7/1985 | Japan . | |
| 63-6092 | 1/1988 | Japan . | |

*Primary Examiner*—Prince Willis, Jr.
*Assistant Examiner*—J. Silbermann
*Attorney, Agent, or Firm*—Antonelli, Terry, Stout & Kraus

[57] ABSTRACT

A lubricating oil for hydrogen-containing Flon refrigerants, comprising as a main component a high-viscosity alkylbenzene having a kinematic viscosity at 40° C. of 50 cSt or higher. Lubricating oil composition for hydrogen-containing Flon refrigerants, comprising as the main components the abovementioned high-viscosity alkylbenzene and (B) a mineral oil having a kinematic viscosity at 40° C. of 50 cSt or higher, a pour point of −15° C. or lower and a nitrogen content of 100 ppm or lower or (C) polyglycol having a kinematic viscosity at 40° C. of 50 cSt or higher and a viscosity index of 150 or more. Furthermore, the above-mentioned high-viscosity alkylbenzene, the mineral oil and polyglycol can be used combinedly. In that combination use, mineral oils and polyglycols having kinematic viscosity at 40° C. of lower than 50 cSt can also be used. The lubricating oil and lubricating oil compositions of the present invention are suitable lubricants for refrigerators, coolers, heat pumps and so forth using hydrogen-containing Flon compounds as refrigerants.

8 Claims, No Drawings

LUBRICATING OIL AND COMPOSITIONS FOR THE HYDROGEN-CONTAINING FLON REFRIGERANTS

This application is a continuation of application Ser. No. 259,590, filed Oct. 19, 1998 now abandoned.

BACKGROUND OF THE INVENTION

1. Field of the Invention

The present invention relates to a lubricating oil and lubricating oil compositions for hydrogen-containing Flon (fluorohydrocarbon) refrigerants, and more particularly to a lubricating oil and lubricating oil compositions useful as lubricants for the system contacting hydrogen-containing Flon compounds, particularly for refrigerators which employ the said hydrogen-containing Flon compounds as refrigeratns.

2. Description of the Related Art

The main refrigerants employed now in refrigerator oils are Flon compounds such as trichloromonofluoromethane (Flon-11) and dichloromonofluoromethane (Flon-12) which contain no hydrogen. However, these Flon compounds are being restricted in their use internationally, since most of them reach the stratosphere without decomposing when released out into the atmosphere, and destroy the ozonosphere. Accordingly, hydrogen-containing Flon compounds, which are relatively easy to decompose, are expected to be used as refrigerants. The problem in this case is that the temperature at which the refrigerant and the lubricating oil are separated is so high that they are easily separated into two phases. Said two phase separation temperature is particularly higher in meneral oil base lubricating oil.

Alkylbenzene, which has conventionally been used as a refrigerator oil, has the disadvantages that lubricity and anti-seizure properties are insufficient, and that the oil consumption by evaporation is large.

SUMMARY OF THE INVENTION

An object of the present invention is to provide a lubricating oil suitable as the lubricant for a system where hydrogen-containing Flon compound is used as refrigerant.

Another object of the present invention is to provide a lubricant suitable for refrigerators, coolers and heat pumps which use hydrogen-containing Flon compounds as refrigerants.

A further object of the present invention is to provide a lubricating oil for hydrogen-containing Flon compound, which is low in two phase separation temperature, high in anti-seizure properties, small in oil consumption by evaporation, and excellent in stability.

The present invention relates to the first to fourth inventions as stated under.

The first invention is a lubricating oil for hydrogen-containing Flon refrigerant comprising a high viscosity alkylbenzene having a kinematic viscosity at 40° C. of 50 cSt or higher. The second invention is a lubricating oil composition for hydrogen-containing Flon refrigerants, comprising the abovementioned high-viscosity alkylbenzene as Component (A) and (S) a mineral oil having a kinematic viscosity at 40° C. of 50 cSt or higher, pour point of −15° C. or lower and a nitrogen content of 100 ppm or smaller.

The third invention is a lubricating oil composition for hydrogen-containing Flon refrigerants, comprising the abovementioned Component (A) and (C) a polyglycol having a kinematic viscosity at 40° C. of 50 cSt or higher and a viscosity index of 150 or higher. The fourth invention is a lubricating oil composition for hydrogen-containing Flon refrigerants, comprising the abovementioned Component (A) and (B') a mineral oil having a kinematic viscosity at 40° C. of 5 to 600 cSt, a pour point of not higher than −15° C. and a nitrogen content of 100 ppm or smaller and (C') polyglycol.

DESCRIPTION OF PREFERRED EMBODIMENT

The lubricating oil of the first invention contains as the main component a high-viscosity alkylbenzene, which has a higher viscosity than the alkylbenzene conventionally used for refrigerator oils and the like, and usually has a kinematic viscosity at 40° C. of not lower than 50 cSt, preferably 60 to 300 cSt, and more preferably 70 to 250 cSt. Therein, by the use of alkylbenzene with a kinematic viscosity of lower than 50 cSt, various disadvantages including a large oil-consumption by evaporation, low sealing properties and the like are caused, and anti-seizure properties are insufficient or lubricity is poor.

Preferred examples among various high-viscosity alkylbenzene satisfying the above properties are alkylbenzenes having 20 carbon atoms or more (when the number of alkyl groups is two or more, total carbon atoms of the alkyl groups), such as monoalkylbenzene, dialkylbenzene and trialkylbenzene, more preferably alkylbenzenes having total carbon atoms of 20 or more and also having two or more alkyl groups (including dialkylbenzene). Said high-viscosity alkylbenzene can be used singly without mixing other kinds or as a mixture of two kinds or more, providing that they have a kinematic viscosity of the abovementioned range.

The lubricating oil of the said first invention comprises as the main component the abovementioned high-viscosity alkylbenzene. If necessary, furthermore, an anti-wear agent, a chlorine-capturing agent, an antioxidant, a metal deactivator, a deforming agent and so forth can be added in appropriate amount.

The lubricating oil composition of the second invention comprises the abovementioned high-viscosity alkylbenzene as Component (A) and (B) a mineral oil as main components. Herein the mineral oil as Component (B) has a kinematic viscosity at 40° C. of 50 cSt or more, preferably 60 cSt or more.

A mineral oil having a kinematic viscosity of less than 50 cSt will accompany such disadvantages as large amount of oil consumption by evaporation or lowered sealing-properties. The mineral oil as Component (B) should have a pour point of −15° C. or lower, preferably −20 or lower, most preferably −30 or lower. If the pour point of Component (B) exceeds −15° C., the resulting oil composition becomes poor in low temperature properties, and is insufficient as a lubricant for refrigerators and so forth. The nitrogen content of the said mineral oil should be not higher than 100 ppm preferably not higher than 50 ppm, and more preferably not higher than 30 ppm. If the nitrogen content of a mineral oil exceed 100 ppm, disadvantages such as lowered heat-resistance and discoloration are caused. As Component (B), mineral oils having a kinematic viscosity, a pour point and a nitrogen content in the abovedescribed range can be used. Moreover, sulfur content is preferably not higher than 1% by weight.

Representative examples among various mineral oils satisfying the above properties are: a distillate oil obtained by atomospheric distillation of paraffin base crude oil, intermediate base crude oil, or naphthene base crude oil, or by vacuum distillation of the residual oil from the atmospheric distillation; or refined oils obtained by purifying the above distillate oil with the ordinary methods, that is, solvent-refined oil, hydrogenated refined oil, and dewaxed oil.

In the lubricating oil composition of the second invention, the ratio of high-viscosity alkylbenzene as Component (A) and the mineral oil as Component (B) is not critical, but preferred ratio is less than 150 parts by weight, more preferably 110 to 5 parts by weight of Component (B) to 100 parts by weight of Component (A).

The lubricating oil composition of the third invention comprises a high-viscosity alkylbenzene as Component (A) and (C) polyglycol, which has a kinematic viscosity at 40° C. of 50 cSt usually, preferably in the range of 60 cSt to 800 cSt, and has a viscosity index of 150 or more, preferably 170 or more. If a polyglycol having a kinematic viscosity of less than 50 cSt is used, there caused the problems that the oil consumption by evaporation is high and sealing properties becomes poor, while is a polyglycol having viscosity index of less than 150 is used, the lubricity at high temperatures will be lowered.

In the lubricating oil composition of the third invention, the ratio of a high-viscosity alkylbenzene as Component (A) and a polyglycol as Component (C) is not critical, but preferred ratio is 97 to 3% by weight of (A) high-viscosity alkylbenzene and 3 to 97% by weight of (C) polyglycol.

The lubricating oil composition of the fourth invention comprises a high-viscosity alkylbenzene as Component (A), a mineral oil as (B') and polyglycol as Component (C'). Herein the high-viscosity alkylbenzene as Component (A) is as described before. The mineral oil as Component (B') is not limited to a mineral oil having a kinematic viscosity at 40° C. of 50 cSt or higher, but those having a kinematic viscosity at 40° C. of 5 to 600 cSt also can be applied. The kinematic viscosity of the polyglycol as Component (C') is not critical, and polyglycols having a kinematic viscosity at 0° C. of 10 to 1000 cSt are usually used.

The ratio of Components (A), (B') and (C') in the lubricating oil composition of the fourth invention is not critical, but a preferred ratio is (A) 2 to 20% by weight of high-viscosity alkylbenzene, (B') 2 to 25% by weight of mineral oil and (C') 96 to 65% by weight of polyglycol.

The lubricating oil of the first invention and the lubricating compositions of the second, third and fourth inventions can be compounded with appropriate amounts of an antiwear agent, a chlorine-capturing agent, an antioxidant, a metal deactivator or a defoamer, if necessary.

The lubricating oil and lubricating oil compositions are effective as the lubricant for refrigerators, coolers, heat pumps and the like employing hydrogen-containing Flon refrigerants. In the specification, Flon means fluorine-containing alkane. The representative examples of hydrogen-containing Flon as refrigerant are 1,1-dichloro-2,2,2-trifluoroethane (Flon-123), 1,1,1,2-tetrafluoroethane (Flon-134a), 1-chloro-1,1-difluoroethane (Flon-142b), 1,1-difluoroethane (Flon-152a), trifluoromethane (Flon-23) and monochlorodifluoromethane (Flon-22), which are particularly effective to the above refrigerants.

As described above, the lubricating oil and lubricating oil compositions of the present invention are low in two-phase separation temperature, high in anti-seizure properties, small in oil consumption by evaporation and excellent in stability for hydrogen-containing Flon compounds such as Flon-123, Flon-134a, Flon-142b, Flon-152a, Flon-23 and Flon-22.

Accordingly, the lubricating oil and lubricating oil compositions of the present invention are effectively used as the lubricant for refrigerators, coolers, heat pumps using these hydrogen-containing Flon compounds as refrigerants.

The present invention is described in greater detail with reference to the following examples.

EXAMPLES 1 TO 8 AND COMPARATIVE EXAMPLES 1 TO 6

Samples of lubricating oil or lubricating oil compositions were prepared using the mineral oils and alkylbenzene shown in Table 1, and evaluated by the following methods. The results are shown in Table 2.

Two phase Separation Temperature of Flon-22

A sample and Flon-22 were mixed in a ratio of 2 to 8 (by weight) and a temperature at which the mixture was separated into two phases was measured. In Table 1, X shows two phase separation temperature of more than 10° C., ◯ shows 10° to 0° C. and ◎ shows less than 0° C.

Falex Seizure Test

Measured according to ASTM D3233 and indicated in terms of seizure load (pounds).

Shield Tube Test

A 2:1 (by weight) mixture of a sample and Flon-22 was placed in a glass tube along with a catalyst of iron, copper and aluminum and sealed. After heating at 175° C. for 720 hours, the appearance and the formation of precipitate were examined.

TABLE 1

| Sample No. | Type of Sample | Kinematic Viscosity at 40° C. (cSt) | Pour point (°C.) | Nitrogen Content (ppm) | Sulfur Content (%) |
|---|---|---|---|---|---|
| I | Paraffin Base Mineral Oil | 95 | −20 | 10 | 0.01 |
| II | Paraffin Base Mineral Oil | 92 | −15 | 120 | 0.5 |
| III | Naphthene Base Mineral Oil | 90 | −25 | 10 | 0.3 |
| IV | Naphthene Base Mineral Oil | 94 | −15 | 150 | 2.5 |
| V | Alkylbenzene*1 | 32 | −60> | 0 | 0 |
| VI | Alkylbenzene*2 | 56 | −60> | 0 | 0 |
| VII | Alkylbenzene*3 | 90 | −50 | 0 | 0 |

*1Alkylbenzene (total carbon atoms of alkyl groups: 19 or less):alkylbenzene (total carbon atoms of alkyl groups: 20 or more) = 50:50 (ratio by weight)
*2Alkylbenzene (total carbon atoms of alkyl groups: 19 or less):alkylbenzene (total carbon atoms of alkyl groups: 20 or more) = 30:70 (ratio by weight)
*3Alkylbenzene (total carbon atoms of alkyl groups: 19 or less):alkylbenzene (total carbon atoms of alkyl groups: 20 or more) = 10:90 (ratio by weight)

TABLE 2

| No. | Sample (wt %) | Two Phase Separation Temperature (°C.) | Falex Seizure Test (pound) | Shield Tube Test | |
|---|---|---|---|---|---|
| | | | | Appearance | Precipitate |
| Comparative Example 1 | I (100) | X | 420 | Good | None |

TABLE 2-continued

| No. | Sample (wt %) | Two Phase Separation Temperature (°C.) | Falex Seizure Test (pound) | Shield Tube Test Appearance | Shield Tube Test Precipitate |
|---|---|---|---|---|---|
| Comparative Example 2 | II (100) | X | 450 | Yellow-brown | Precipitated |
| Comparative Example 3 | III (100) | X | 460 | Good | None |
| Example 4 | IV (100) | X | 490 | Blackened | Precipitated |
| Comparative Example 5 | V (100) | ◎ | 250 | Good | None |
| Example 1 | VI (100) | ◎ | 340 | Good | None |
| Example 2 | VII (100) | ◎ | 400 | Good | None |
| Comparative Example 6 | I (50), III (50) | X | 440 | Good | None |
| Example 3 | I (50), VI (50) | ○ | 370 | Good | None |
| Example 4 | I (50), VII (50) | ○ | 410 | Good | None |
| Example 5 | III (50), VI (50) | ○ | 380 | Good | None |
| Example 6 | III (50), VII (50) | ○ | 430 | Good | None |
| Example 7 | I (30), VII (70) | ○ | 410 | Good | None |
| Example 8 | III (30), VII (70) | ◎ | 420 | Good | None |

EXAMPLES 9 TO 10 AND COMPARATIVE EXAMPLES 7 TO 10

Samples of lubricating oil or lubricating oil compositions were prepared using the mineral oils, alkylbenzene and polyglycol shown in Table 3, and evaluated by the similar methods to the above. The results are shown in Table 4.

TABLE 3

| Sample No. | Type of Sample | Kinematic Viscosity at 40° C. (cSt) | Viscosity Index |
|---|---|---|---|
| VIII | Paraffin Base Mineral Oil | 92 | 90 |
| IX | Naphthene Base Mineral Oil | 95 | 40 |
| X | Alkylbenzene*1 | 29 | 0 or less |
| XI | Alkylbenzene*2 | 56 | 0 or less |
| XII | Alkylbenzene*3 | 90 | 5 |

TABLE 3-continued

| Sample No. | Type of Sample | Kinematic Viscosity at 40° C. (cSt) | Viscosity Index |
|---|---|---|---|
| XIII | Polyglycol*4 | 227 | 212 |

*1Ratio of alkylbenzene (A) (total carbon atoms of alkyl groups: 19 or less) and alkylbenzene (B) (total carbon atoms of alkyl groups: 20 or more), A:B = 50:50 (Ratio by weight)

*2Ratio of alkylbenzene (A) (total carbon atoms of alkyl groups: 19 or less) and alkylbenzene (B) (total carbon atoms of alkyl groups: 20 or more), A:B = 30:70 (Ratio by weight)

*3Ratio of alkylbenzene (A) (total carbon atoms of alkyl groups: 19 or less) and alkylbenzene (B) (total carbon atoms of alkyl groups: 20 or more), A:B = 10:90 (Ratio by weight)

*4Polyoxypropyleneglycol monobutylether: Molecular weight: 1900

TABLE 4

| No. | Sample (wt %) | Two Phase Separation Temperature (°C.) | Falex Seizure Test (pound) | Shield Tube Test Appearance | Shield Tube Test Precipitate | Evaporator Test (wt %) |
|---|---|---|---|---|---|---|
| Comparative Example 7 | VIII (100) | X | 400 | Good | None | 0.5> |
| Comparative Example 8 | IX (100) | X | 450 | Yellow-brown | Precipitated | 0.5> |
| Comparative Example 9 | X (100) | ◎ | 250 | Good | None | 23.4 |
| Example 9 | XI (50), XIII (50) | ◎ | 530 | Good | None | 12.7 |
| Example 10 | XII (50), XIII (50) | ◎ | 540 | Good | None | 7.9 |
| Comparative Example 10 | X (50), XIII (50) | ◎ | 490 | Good | None | 20.5 |

EXAMPLES 11 TO 18

Samples of lubricating oil or lubricating oil compositions were prepared using the mineral oils, alkylbenzenes and polyglycols shown in Table 5, and evaluated according to the methods mentioned above. The results are shown in Table 5. However, Antiwear Test was carried out in accordance with ASTMD 2670, evaluating with the conditions of 150 pounds of load, for an hour, and 10 liters/hour of blow rate, by the use of Flon-22 as a refrigerant.

TABLE 5

| No. | Composition (wt %) Alkylbenzene $A_1$*1 | $A_2$*2 | $A_3$*3 | Mineral Oil $B_1$*4 | $B_2$*5 | Polyglycol $C_1$*6 | $C_2$*7 | Two Phase Separation Temperature To Flon-22 | To Flon-134a |
|---|---|---|---|---|---|---|---|---|---|
| Example 11 | 18 | — | — | 12 | — | 70 | — | ◎ | ○ |
| Example 12 | 15 | — | — | 5 | — | 80 | — | ◎ | ○ |
| Example 13 | 10 | — | — | 10 | — | 80 | — | ◎ | ○ |
| Example 14 | 3 | — | — | 3 | — | 94 | — | ◎ | ◎ |

TABLE 5-continued

| | | | | | | | | | |
|---|---|---|---|---|---|---|---|---|---|
| Example 15 | — | 12 | — | — | 8 | 80 | — | ◎ | ○ |
| Example 16 | — | 6 | — | — | 4 | 90 | — | ◎ | ◎ |
| Example 17 | 10 | — | — | — | 5 | — | 85 | ◎ | ○ |
| Example 18 | 7 | — | — | — | 3 | — | 90 | ◎ | ◎ |

| | Shield Tube Test (Appearance) | | Lubricity | |
|---|---|---|---|---|
| No. | To Flon-22 | To Flon-134a | Antiwear Properties (mg) | Anti-Seizure Properties (pound) |
| Example 11 | Good | Good | 1 | 400 or more |
| Example 12 | Good | Good | 2 | 400 or more |
| Example 13 | Good | Good | 1 | 400 or more |
| Example 14 | Good | Good | 2 | 400 or more |
| Example 15 | Good | Good | 1 | 400 or more |
| Example 16 | Good | Good | 2 | 400 or more |
| Example 17 | Good | Good | 2 | 400 or more |
| Example 18 | Good | Good | 3 | 400 or more |

*1Same as Sample No. VI in Table 1 (kinematic viscosity at 40° C.: 56 cSt)
*2Same as Sample No. VII In Table 1 (kinematic viscosity at 40° C.: 90 cSt)
*3Alkylbenzene (total carbon atoms of alkyl groups: 19 or less):alkylbenzene (total carbon atoms of alkyl groups: 20 or more) = 90:10 (ratio by weight) (kinematic viscosity at 40° C.: 14 cSt)
*4Naphthene base mineral oil: kinematic viscosity at 40° C.: 9 cSt, nitrogen content: 10 ppm, sulfur content: 0.5% by weight, pour point: - 35° C.
*5Naphthene base mineral oil: kinematic viscosity at 40 C.: 32 cSt, nitrogen content: 10 ppm, sulfur content: 0.35% by weight, pour point: - 30° C.
*6Polyoxypropyleneglycol monobutylether: molecular weight: 700, kinematic viscosity at 40° C.: 32 cSt
*7Polyoxypropyleneglycol monobutylether: molecular weight: 1000, kinematic viscosity at 40° C.: 56 cSt

*1 Same as Sample No. VI in Table 1 (kinematic viscosity at 40° C.: 56 cSt)
*2 Same as Sample No. VII In Table 1 (kinematic viscosity at 40° C.: 90 cSt)
*3 Alkylbenzene (total carbon atoms of alkyl groups: 19 or less) : alkylbenzene (total carbon atoms of alkyl groups: 20 or more)=90:10 (ratio by weight) (kinematic viscosity at 40° C.: 14 cSt)
*4 Naphthene base mineral oil: kinematic viscosity at 40° C.: 9 cSt, nitrogen content: 10 ppm, sulfur content: 0.5% by weight, pour point:−35° C.
*5 Naphthene base mineral oil: kinematic viscosity at 40° C.: 32 cSt, nitrogen content: 10 ppm, sulfur content: 0.35% by weight, pour point:−30° C.
*6 Polyoxypropyleneglycol monobutylether: molecular weight: 700, kinematic viscosity at 40° C.: 32 cSt
*7 Polyoxypropyleneglycol monobutylether: molecular weight: 1000, kinematic viscosity at 40° C.: 56 cSt

What is claimed is:

1. A lubricating oil composition for refrigerants comprising 1,1-dichloro-2,2,2-trifluoroethane; 1,1,1,2-tetrafluoroethane; 1-chloro-1,1-difluoroethane; 1,1-difluoroethane; trifluoromethane or monochlorodifluoromethane, comprising as the main components (A) high-viscosity alkylbenzenes with a kinematic viscosity at 40° C. of at least 50 cSt comprising at least 70% by weight of dialkylbenzenes containing at least 20 carbon atoms in the alkyl groups and (C) a polyoxypropylene glycol monobutyl ether having a kinematic viscosity at 40° C. of 50 cSt or higher, and a viscosity index of 50 or higher; a ratio of (A)/(C) being 97 to 3% by weight of (A) and 3 to 97% by weight of (C).

2. A lubricating oil composition as defined in claim 1, wherein the kinematic viscosity at 40° C. of (A) high-viscosity alkylbenzene is in the range of 60 to 300 cSt.

3. A lubricating oil composition as defined in claim 1, wherein the alkylbenzenes further contain not more than 30% by weight of alkylbenzenes having a carbon content in the alkyl group not greater than 19 carbon atoms.

4. A lubricating oil composition for refrigerants comprising 1,1-dichloro-2,2,2-trifluoroethane; 1,1,1,2-tetrafluoroethane; 1-chloro-1,1-difluoroethane; 1,1-difluoroethane; trifluoromethane or monochlorodifluoromethane, comprising as the main components (A) high-viscosity alkylbenzenes with a kinematic viscosity at 40° C. of at least 50 cSt comprising at least 70% by weight of dialkylbenzenes containing at least 20 carbon atoms in the alkyl groups and (B') a mineral oil having a kinematic viscosity at 40° C. of at least 50 cSt, a pour point of −15° C. or lower and a nitrogen content of 100 ppm or less and (C') polyoxypropylene glycol monobutyl ether; the ratio of (A)/(B')/(C') being 2 to 20% by weight of (A), 2 to 15% by weight of (B') and 96 to 65% by weight of (C'); the (B') mineral oil having a sulfur content not higher than 1% by weight.

5. A lubricating oil composition as defined in claim 4, wherein the kinematic viscosity at 40° C. at (A) a high-viscosity alkylbenzene is in the range of 60 to 300 cSt.

6. A lubricating oil composition as defined in claim 4, wherein the kinematic viscosity at 40° C. of (B') mineral oil is in the range of 5 to 600 cSt.

7. A lubricating oil composition as defined in claim 4, herein the kinematic viscosity at 40° C. of (C') is in the range of 10 to 1000 cSt.

8. A lubricating oil composition as defined in claim 4, wherein the alkylbenzenes further contain not more than 30% by weight of alkylbenzenes having a carbon content in the alkyl group not greater than 19 carbon atoms.

* * * * *